US005123893A

United States Patent [19]

Grooms

[11] Patent Number: 5,123,893

[45] Date of Patent: Jun. 23, 1992

[54] PASSIVE PAPER STACKER

[75] Inventor: Joseph D. Grooms, Boise, Id.

[73] Assignee: Hewlett-Packard Company, Palo Alto, Calif.

[21] Appl. No.: 678,494

[22] Filed: Apr. 1, 1991

[51] Int. Cl.[5] ..... B65H 45/101; B65H 45/107

[52] U.S. Cl. ..... 493/410; 493/411

[58] Field of Search ..... 493/409, 410, 411, 412, 493/451, 455, 456, 461

[56] References Cited

U.S. PATENT DOCUMENTS

| | | | |
|---|---|---|---|
| 2,906,527 | 9/1959 | Blain | 493/411 |
| 3,442,503 | 5/1969 | Call | 493/410 |
| 3,464,610 | 9/1969 | Koning | 493/411 |
| 3,514,096 | 5/1970 | Muller | 493/410 |
| 3,735,975 | 5/1973 | Sukel et al. | 493/410 |
| 4,054,235 | 10/1977 | Witcher | 493/410 |
| 4,226,410 | 10/1980 | McIntosh et al. | 493/410 |
| 4,559,031 | 12/1985 | Gysling et al. | 493/410 |

FOREIGN PATENT DOCUMENTS

| | | | |
|---|---|---|---|
| 0156727 | 12/1979 | Japan | 493/411 |

OTHER PUBLICATIONS

David, W. K., "Fan-Fold Paper Rack", IBM Technical Disclosure Bulletin, vol. 4, No. 1, Jun. 1961.

*Primary Examiner*—William E. Terrell

[57] ABSTRACT

A passive paper stacker for a printer is disclosed which is able to stack a series of pages of a Z-fold paper web, each page having a length L and a width W. The stacker includes a tray that extends from a surface of the printer. The paper web, as it exits from the printer intersects that surface. A ramp is provided to receive the paper web and has both proximal and distal ends, the proximal end receiving the paper web as it exits from the printer and the distal end positioned closer to the tray than the proximal end and at a distance from the printer surface that is at least equal to L/2. First and second sets of chains define a paper web fall path from the distal end of the ramp to the base. The first set of chains are positioned between the distal end of the ramp and the printer surface and the second set of chains are positioned so as to place the distal end of the ramp between the second set of chains and the printer surface. A basket is positioned on the tray and receives the paper web. The basket and chains prevent the web from contacting the printer surface and obtaining a static charge.

9 Claims, 5 Drawing Sheets

PASSIVE PAPER STACKER

FIELD OF THE INVENTION

This invention relates to paper stackers, more particularly, to a passive paper stacker for handling large quantities of Z-fold paper stock.

BACKGROUND OF THE INVENTION

Many printers employ continuous webs of paper known as "Z-fold" paper stock for large print jobs. A box of Z-fold paper often contains 2000–3000 sheets, depending upon the paper weight. Prior art stackers have, in the main, been only able to stack 400–500 sheets of such Z-fold stock before allowing the remainder to spill onto the floor.

Prior art stackers also have allowed the paper to pass too close to the back of the printer where a static charge build up could occur. Such static charge caused the paper to adhere to the back of the machine and impeded its proper stacking.

In U.S. Pat. No. 4,559,031 to Gysling et al., assigned to the same assignee as this application, a passive paper stacker is shown wherein paper output from a printer is guided by an exit ramp toward a base, where the paper is automatically stacked. The base includes a starter ramp for automatically positioning a first page of the paper to permit orderly stacking of later pages. A set of paper-fold "dive-arrestors" are employed to catch diving folds and redirect then towards their proper position on the stack of paper. The operation of the dive arrestor, however, may force the paper into contact with the surface of the printer, where a static charge can be acquired that hinders the paper's stacking. Further, once the paper stack reaches the bottommost edge of the dive arrestors, the paper no longer is able to stack in an orderly manner.

Accordingly, it is an object of this invention to provide a passive paper stacker particularly adapted to handling large quantities of Z-fold paper stock.

It is another object of this invention to provide a passive paper stacker that has the capability to properly stack up to 3000 sheets of Z-fold paper.

It is yet another object of this invention to provide a passive paper stacker for a printer which is constructed to avoid the occurrence of static charge build up as paper is being stacked.

SUMMARY OF THE INVENTION

A passive paper stacker for a printer is disclosed which is able to stack a series of pages of a Z-fold paper web, each page having a length L and a width W. The stacker includes a tray that extends from a surface of the printer. The paper web, as it exits from the printer intersects that surface. A ramp is provided to receive the paper web and has both proximal and distal ends, the proximal end receiving the paper web as it exits from the printer and the distal end positioned closer to the tray than the proximal end and at a distance from the printer surface that is at least equal to L/2. First and second sets of chains define a paper web fall path from the distal end of the ramp to the base. The first set of chains are positioned between the distal end of the ramp and the printer surface and the second set of chains are positioned so as to place the distal end of the ramp between the second set of chains and the printer surface. A basket is positioned on the tray and receives the paper web. The basket and chains prevent the web from contacting the printer surface and obtaining a static charge.

DETAILED DESCRIPTION OF THE INVENTION

Figure 1:
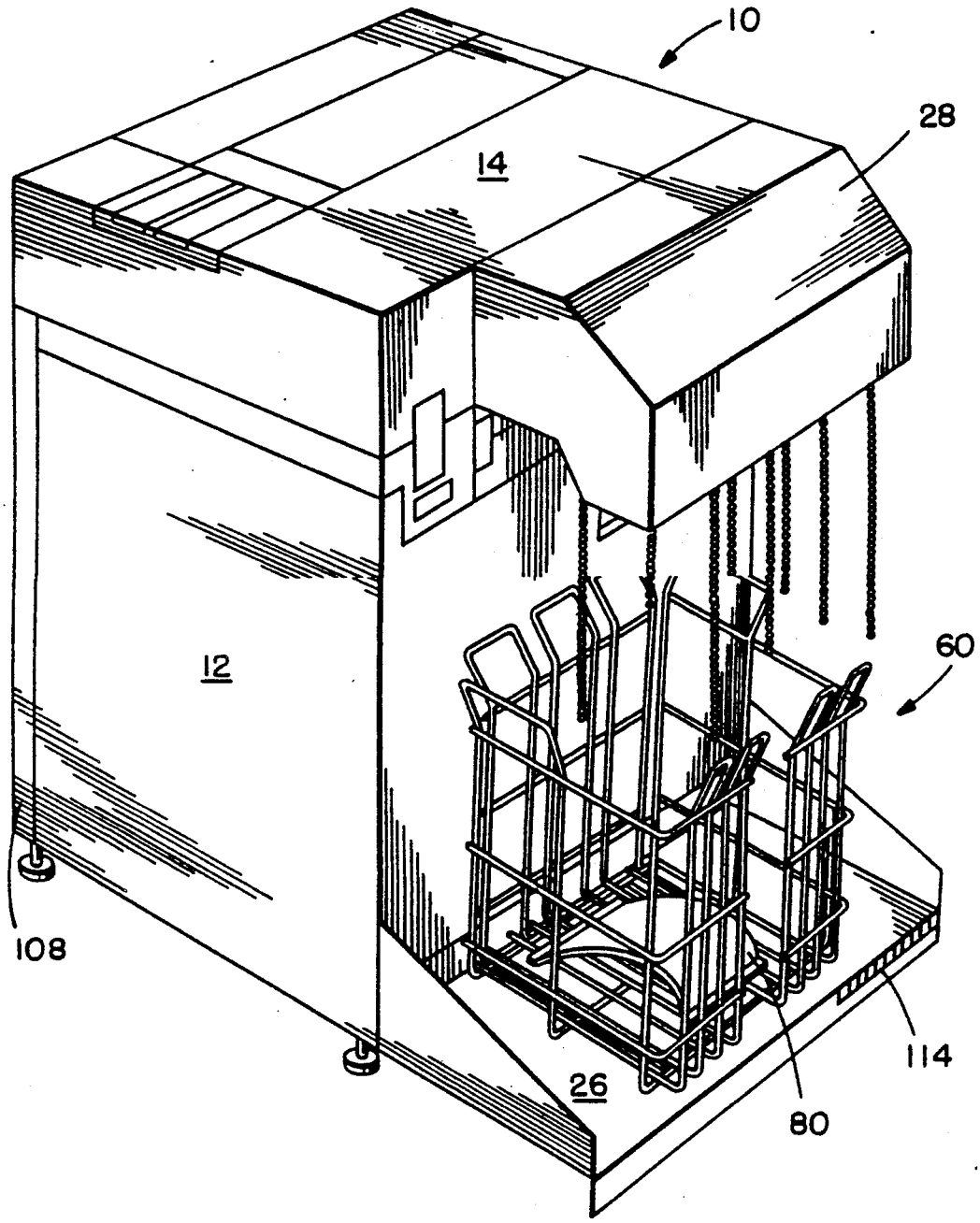
FIG. 1 is a perspective view of a printer having a passive paper stacker that incorporates the invention hereof.
Figure 2:
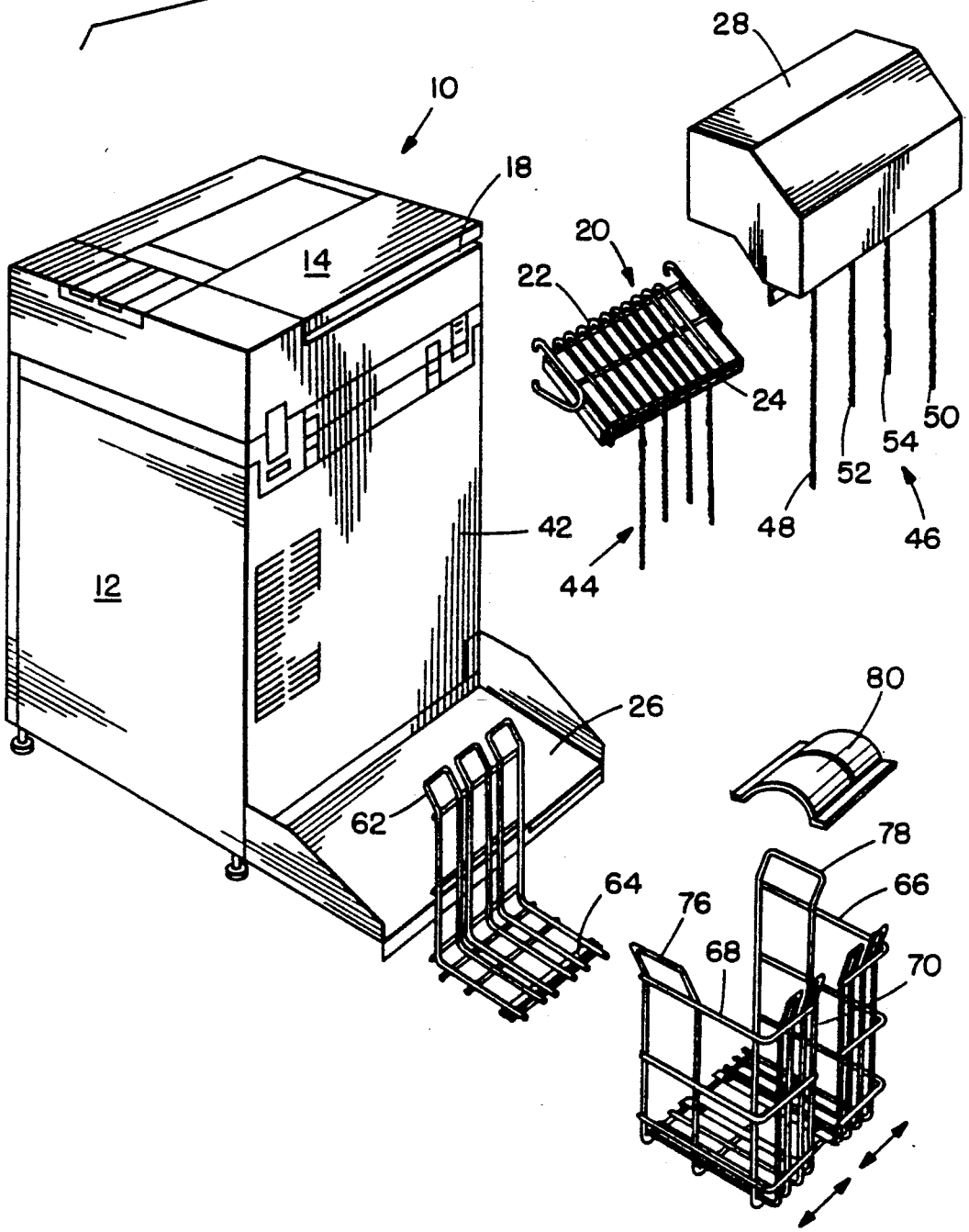
FIG. 2 is an exploded perspective view of FIG. 1 showing the various elements of the passive paper stacker.
Figure 3:
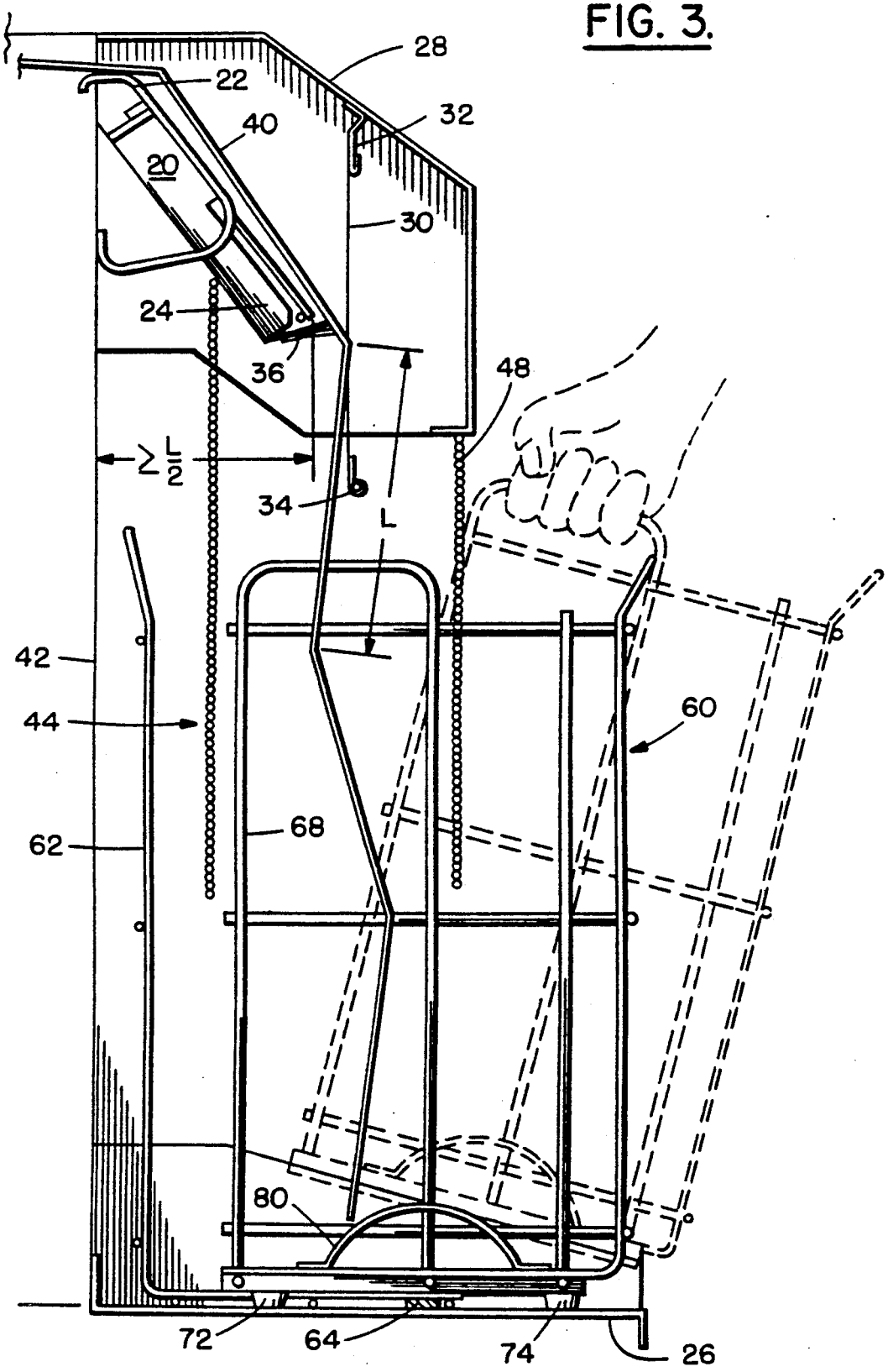
FIG. 3 is a schematic section of the passive paper stacker showing the installed positioned of various of its elements.

Referring now to FIGS. 1–3, a printer 10 is provided with both a stand 12 and a print mechanism 14. Within stand 12 is a space for storing a stack of Z-fold paper from where it can be fed into print mechanism 14. After printing, the Z-fold paper exits from print mechanism 14 via an opening 18 (see FIG. 2). A tilted paper ramp 20 has a proximal end 22 positioned immediately adjacent opening 18 and a distal end 24 over which the paper passes as it falls downwardly towards a tray 26. At distal end 24 of paper ramp 20 is positioned (See FIG. 3) a static discharge brush 25 that contacts Z-fold paper 40 as it passes over the lip of the paper ramp.

A sound shroud 28 encompasses paper ramp 20 and a forms breaker 30 (see FIG. 3). Forms breaker 30 is oriented parallel to the lip of distal end 24 of paper ramp 20. Forms breaker 30 comprises a sheet material that hangs down from a bracket 32 and has a weight 34 attached to its lowermost portion. Forms breaker 30 may comprise any antistatic material, however it is preferred that it be a mylar sheet having a grounded conductive coating, to enable static discharge.

Forms breaker 30 forces paper web 40 to "break" at perforations between pages in the Z-fold web. Furthermore, to the extent that web 40 kinks or otherwise becomes non-planar across the lip of distal end 24 of ramp 20, forms breaker 30 will restore its planar configuration as it forces web 40 to traverse downwardly towards base 26.

Each individual sheet of paper in web 40 has a length L and a width (not shown) W. It is important that distal end 24 of paper ramp 20 be positioned a distance that is at least L/2 or greater from surface 42 of printer 10. This enables the folds of web 40 to fall to tray 26 and not touch surface 42. As a result, there is no static charge transfer from surface 42 to paper web 40.

Two sets of chains 44 and 46, respectively, define a paper web fall path between the distal end 24 of paper ramp 20 and tray 26. An external set of chains 46 comprise a pair of outer chains 48 and 50 positioned apart by a distance less than W and a pair of lesser length inner chains 52 and 54. Each of those chains extends downwardly from the outer wall of sound shroud 28. A similar set of internal chains 44 extend down from approximately the mid-point of the underside of paper tray 20.

Internal and external sets of chains 44 and 46 prevent the paper web from billowing out as it falls and also catch the edges of the paper folds to aid in forming a stack. Each of the individual chains is preferably a ball type chain structure so that the spaces between the balls catches the paper edges. The lesser length inner chains constrain the paper web fall path when the paper stack approaches the bottom thereof. Thus, as the paper stack builds up to the level of the longer chains i.e. 48 and 50 (and corresponding chains in chain set 44), the outer chains confine the paper stack. However, as the height increases of the stack of folded paper, inner chains 52 and 54 come into play and add to the constraining action exerted by outer chains 48 and 50 (as do like chains in chain set 44).

A paper stacking basket 60 is placed on tray 26 below the paper fall path and is comprised of three parts. As shown in FIG. 2, a separate backstop 62 is formed of an L-shaped set of metal or plastic rods and sits directly on tray 26. A bar magnet 64 maintains backstop 62 in place, once it is properly positioned on tray 26. The remainder of basket 60 comprises right and left portions of 66 and 68. Each portion includes a planar side that is integral with front and bottom half-sides, respectively. Bars 69 which run along the bottom half-sides are slidably engaged so that the distance between portions 66 and 68 can be adjusted by simply sliding bars 69 apart or pushing them together. It is preferred, that when basket portions 66 and 68 are pushed together, that an opening 70 remain therebetween so as to enable hand access to the front side of a paper stack.

As can be seen from FIG. 3, when basket 60 is in place on tray 26, it sits on feet pairs 72 and 74. Those feet allow the bottom portion of backstop 62 to slide beneath the lower surface of basket 60, to thereby complete its rear side. A pair of handles 76 and 78 are positioned off-center from portions 68 and 66 so that when basket 60 is lifted off tray 26, the basket tips rearwardly thereby causing any paper stack therein to press against the front side of the basket.

A forms break 80 may be placed in the bottom of basket 60 and oriented back to front or sideways, depending upon the size and weight of the paper web. Forms break 80 forces the paper web into an inverse arch to prevent early failure of the stack due to its building too fast at the edges.

Figure 4A:
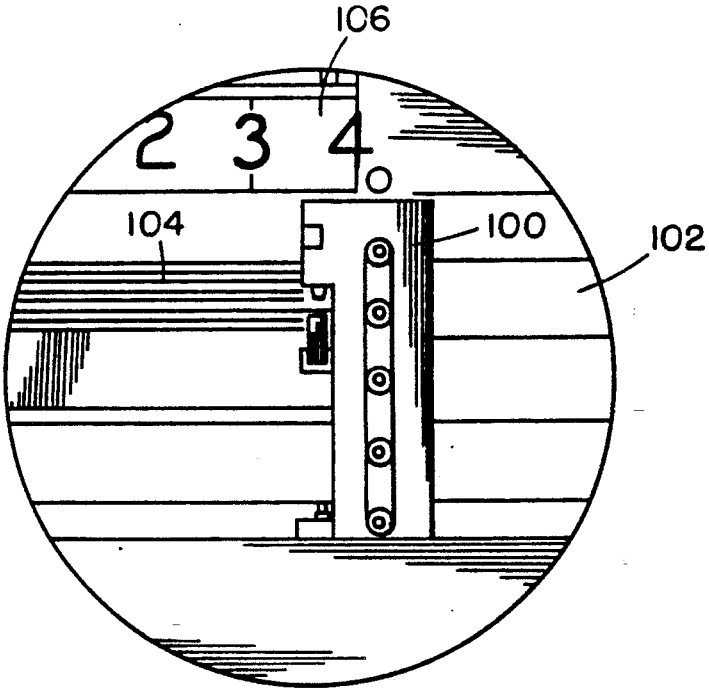
FIG. 4A is an expanded view of a portion of FIG. 4.
Figure 4:
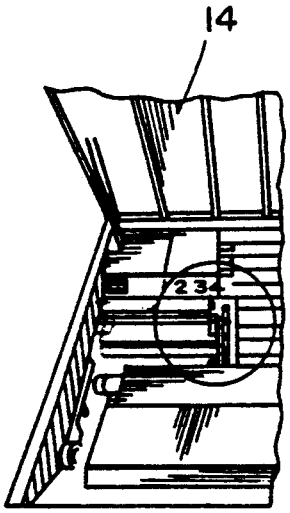
FIG. 4 shows a view of the paper movement mechanism within the printer and a ruled indicator that enables straight through feed of the Z-fold paper web.
Figure 5:
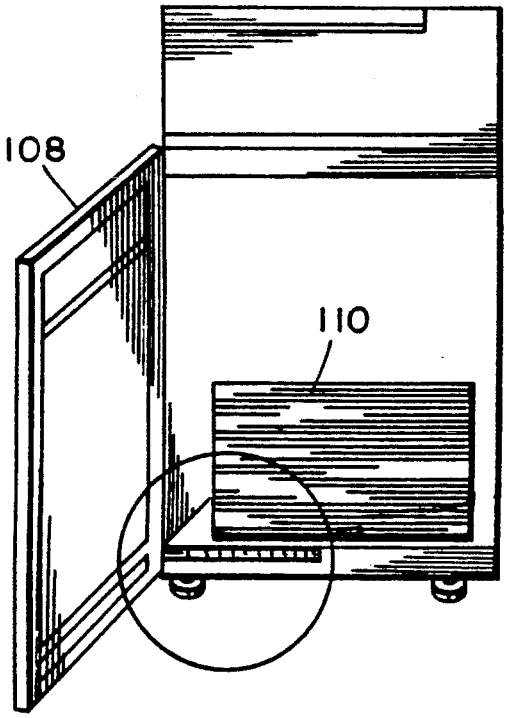
FIG. 5 shows a view of the initial stack of Z-fold paper and a ruled indicator that enables the stack's proper placement.
Figure 6:
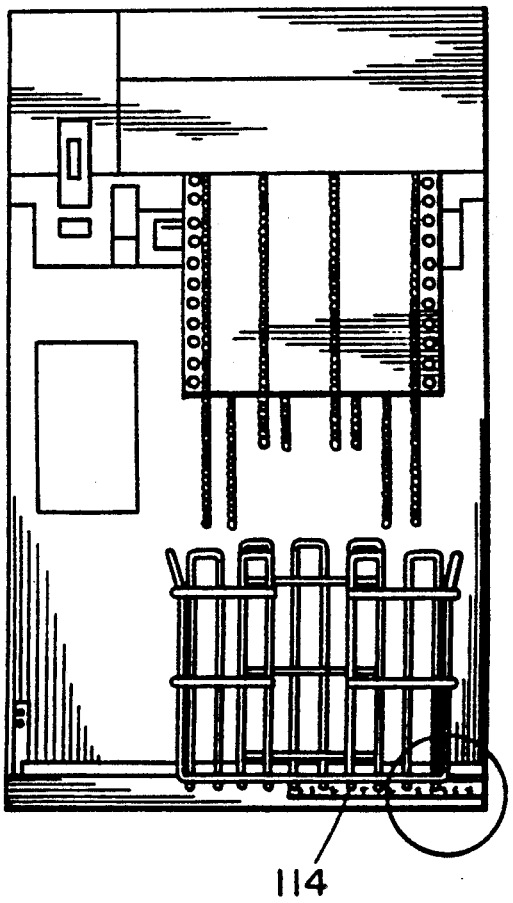
FIG. 6 shows a view of the paper tray along with a ruled indicator enabling proper placement of the paper-receiving basket.

Referring now to FIGS. 4–6, ruled indicators are placed at critical points on the printer to assure a straight-through feed of the Z-fold paper web. In FIG. 4, the top cover of print mechanism 14 has been raised, exposing the left hand portion of the paper movement tractor. In FIG. 4A, the left tractor is shown which is movable both to the right and to the left, in dependence upon the width of paper web 102.

Tractor mechanism 100 is driven by a rotatable splined shaft 104. A ruled indicator 106 is placed directly above tractor mechanism 100 and indicates the position of the leftmost edge of paper web 102. It is the position on indicator 106 that controls the placement position of both the original paper stack within stand 12 and the placement of basket 60.

Figure 5A:
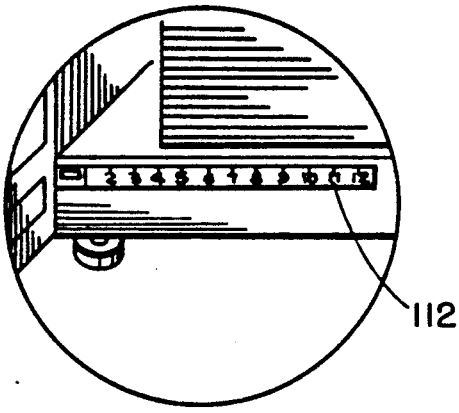
FIG. 5A is an expanded view of a portion of FIG. 5.

As shown in FIGS. 5 and 5A, door 108 (see FIG. 1) has been opened showing an initial stack of Z-fold paper 110. A ruled indicator 112, which is aligned with ruled indicator 106, is placed beneath stack 110 and indicates where the stack's leftmost edge should reside (based upon the position of paper web 102 with respect to ruled indicator 106).

Figure 6A:
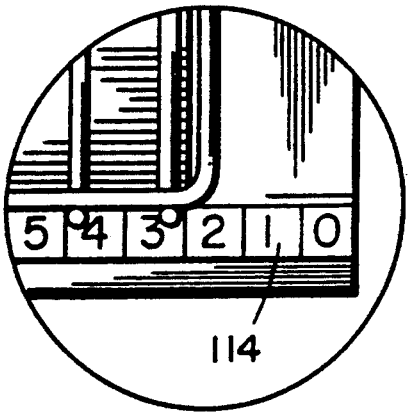
FIG. 6A is an expanded view of a portion of FIG. 6.

Next, as shown in FIGS. 6 and 6A, an additional ruled indicator 114 is placed along the frontmost portion of tray 26. When paper basket 60 is placed on tray 26, its rightmost edge should be aligned so that it will not interfere with a paper stack whose leftmost edge has been aligned as shown in FIGS. 4 and 5. In other words, the edge of basket 60 should extend further to the right of the "4" marking, so as to provide clearance for the paper stack. Each of ruled indicators 106, 112 and 114 is aligned during the manufacture of the printer to positionally conform and enable a straight-through paper feed path, when the above-described alignments are accomplished.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. A passive paper stacker appended to a printer, for attaching a series of pages of a Z-fold paper web, each said page having a length L and width W, said stacker comprising:

a tray extending from a printer surface, said paper web exiting from said printer and intersecting said surface;

ramp means for receiving said paper web and having proximal and distal ends, said proximal end receiving said paper web exiting from said printer, said distal end positioned closer to said tray than said proximal end and at a distance from said printer surface that is at least L/2;

first and second sets of chains defining a paper web fall path from said distal end of said ramp means to said tray, the first set of chains positioned between said distal end of said ramp means and said printer surface, and the second set of chains positioned so as to place said distal end of said ramp means between the second set of chains and the printer surface, each said set of chains including outer chains encompassing inner chains, said outer chains of longer length than said inner chains, said outer chains initially engaging a Z-fold stack of pages and controlling their stacking action, said inner chains operative to further control said stacking action when said stack comes into engagement therewith; and basket means positioned on said tray, for receiving said paper stack.

2. The passive paper stacker of claim 1, further comprising:

a breaker surface comprised of antistatic sheet material positioned adjacent said distal end of said ramp means for engaging said paper web across its width W, for flattening kinks in said paper web after it passes over said distal end.

3. The passive stacker of claim 2, wherein said distal end of said ramp means includes an anti-static brush positioned to engage said paper web.

4. The passive stacker of claim 1, wherein said basket means includes two planar end enclosures, each having a portion of front and bottom enclosures integral therewith, said end enclosures slidably associated with respect to each other so as to allow a adjustment of the distance therebetween while maintaining said basket means as an integral unit.

5. The passive stacker of claim 4, wherein said basket means further includes a separate rear enclosure with a base portion positionable beneath said bottom enclosures, whereby the removal of said slidably associated end enclosures may be accomplished without disturbing said separate rear enclosure.

6. The passive stacker of claim 5, wherein each said separate side enclosure has handles, at its uppermost extent, said handles positioned off center so that said basket means will tip away from said printer surface when it is raised by said handles.

7. The passive stacker of claim 6, wherein said front portions of said opposing front side enclosures do not abut each other and thereby leave a space through which stacked paper in said basket means can be grasped.

8. The passive paper stacker of claim 4 wherein said printer and tray are provided with first and second ruled indicators, respectively, that enable user placement of said basket in conformance with said paper web's position in respect of said printers, ruled indicator, whereby a straight paper feed path is assured.

9. The passive paper stacker of claim 8 wherein said printer has a space for a clean paper stack, said space also having a third ruled indicator aligned with said first and second ruled indicators.

* * * * *